US009352597B2

(12) United States Patent
Sakaino

(10) Patent No.: US 9,352,597 B2
(45) Date of Patent: May 31, 2016

(54) PAPER EJECTOR UNIT FOR USE WITH A PRINTING MECHANISM OF A PRINTER HAVING A PAPER TRANSPORT PATH

(71) Applicants: CITIZEN HOLDINGS CO., LTD., Tokyo (JP); CITIZEN SYSTEMS JAPAN CO., LTD., Tokyo (JP)

(72) Inventor: Tsuyoshi Sakaino, Higashikurume (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 0 days.

(21) Appl. No.: 14/031,492

(22) Filed: Sep. 19, 2013

(65) Prior Publication Data

US 2014/0076914 A1 Mar. 20, 2014

(30) Foreign Application Priority Data

Sep. 20, 2012 (JP) ..... 2012-206575

(51) Int. Cl.

*B41J 29/38* (2006.01)
*B41J 29/13* (2006.01)
*B41J 11/66* (2006.01)
(Continued)

(52) U.S. Cl.

CPC ..... *B41J 29/38* (2013.01); *B41J 11/663* (2013.01); *B41J 11/70* (2013.01); *B41J 13/106* (2013.01); *B41J 15/005* (2013.01); *B41J 29/13* (2013.01); *G07F 19/201* (2013.01); *G07G 5/00* (2013.01)

(58) Field of Classification Search

CPC ..... B41J 11/70; B41J 11/66; B41J 13/106; B41J 11/663; B41J 29/13; B65H 31/00; B65H 31/02; G07G 5/00; G07F 5/26

See application file for complete search history.

(56) References Cited

U.S. PATENT DOCUMENTS 3,957,173 A * 5/1976 Roudebush ..... G07F 19/202 109/19
4,166,588 A * 9/1979 Krehbiel ..... B65H 18/10 242/348.1

(Continued)

FOREIGN PATENT DOCUMENTS

JP 54-34899 3/1979
JP 59-118061 8/1984

(Continued)

OTHER PUBLICATIONS

Japanese Office Action issued Feb. 23, 2016 in corresponding Japanese Patent Application No. 2012-206575 (with Partial English translation).

*Primary Examiner* — Daniel J Colilla

(74) *Attorney, Agent, or Firm* — Wnderoth, Lind & Ponack, L.L.P.

(57) ABSTRACT

A paper ejector unit which transports paper printed by a printing mechanism of a printer along a transport path includes a paper accumulator provided ahead of an end-of-transport path on a downstream side in a transport direction of the paper, the paper accumulator accumulating the paper ejected from the end, a door which opens and closes between a closed condition in which the paper accumulator is separated from an outside and an open condition in which the paper accumulator communicates with the outside, and a door opening and closing controller which maintains the door in the closed condition with no reception of input of an opening operation signal which opens the door, and changes the door from the closed condition to the open condition with reception of the input of the opening operation signal.

5 Claims, 8 Drawing Sheets

(51) Int. Cl.

| | |
|---|---|
| ***B41J 13/10*** | (2006.01) |
| ***B41J 15/04*** | (2006.01) |
| ***G07F 19/00*** | (2006.01) |
| ***G07G 5/00*** | (2006.01) |
| ***B41J 11/70*** | (2006.01) |
| ***B41J 15/00*** | (2006.01) |

(56) References Cited

U.S. PATENT DOCUMENTS

| | | | | | |
|---|---|---|---|---|---|
| 5,060,880 | A * | 10/1991 | Mayer | 242/419.5 | |
| 7,044,331 | B2 * | 5/2006 | Lee | G07F 19/20 | 109/19 |
| 7,733,361 | B2 * | 6/2010 | Choi et al. | 347/171 | |
| 8,371,763 | B2 * | 2/2013 | Kim et al. | 400/88 | |
| 2011/0101602 | A1 | 5/2011 | Kohyama | 271/225 | |

FOREIGN PATENT DOCUMENTS

| | | | | |
|---|---|---|---|---|
| JP | 06033251 U | * | 4/1994 | |
| JP | 9-204549 | | 8/1997 | |
| JP | 09323854 A | * | 12/1997 | B65H 31/00 |
| JP | 2002-240396 | | 8/2002 | |
| JP | 2002323868 A | * | 11/2002 | G09F 19/00 |
| JP | 2004-54371 | | 2/2004 | |
| JP | 2011-98795 | | 5/2011 | |

* cited by examiner

SECT.G-G

PAPER EJECTOR UNIT FOR USE WITH A PRINTING MECHANISM OF A PRINTER HAVING A PAPER TRANSPORT PATH

PRIORITY CLAIM

The present application is based on and claims priority from Japanese Patent Application No. 2012-206575, filed on Sep. 20, 2012, the disclosure of which is hereby incorporated by reference in its entirety.

BACKGROUND

1. Field of the Invention

The present invention relates to a paper ejector unit, a printer, and particularly to an improved mechanism which does not allow a user to touch paper while printing.

2. Description of Related Art

A paper ejector unit for use in a printed paper-issuing machine such as a ticket-vending machine is configured to prevent the paper from being pulled by a user while printing.

Patent Document 1 (JP2011-98795A) proposes a technique which temporarily holds the printed paper between an exit slot serving as an end-of-transport path from which the paper is ejected and a printing mechanism or a cutter by deflecting the printed paper, prevents the paper from being ejected from the exit slot before the printing is over, and ejects the deflected and held paper from the exit slot after the printing is over. Patent Document 2 (JP S59-118061U) proposes a technique which does not allow a user to touch paper while printing by providing a door in a paper accumulator in which a paper ejected from the exit slot is accumulated, and maintaining the door in a closed condition while printing the paper.

According to these techniques, a problem due to pulling of paper can be avoided because a user cannot touch the paper while printing.

However, the technique disclosed in Patent Document 1 requires a certain amount of distance between the exit slot and the printing mechanism or the cutter in order to provide a standby space for paper between the exit slot and the printing mechanism or the cutter. For this reason, the unit cannot be downsized.

The technique described in Patent Document 1 also requires many components such as a transport roller in order to provide the standby space, which makes it difficult to reduce manufacturing costs.

Furthermore, the standby space has a portion with no transport path. With this configuration, it is necessary to use paper having a length which is longer than the portion with no transport path in order to allow the passing of paper over the portion with no transport path, and it is necessary to ensure a blank space to some extent even if information to be printed is small.

With the technique described in Patent Document 2, the paper is pulled based on a user's judgment.

Namely, the user recognizes that the printing is completed when the user can open the door by touch, and can pull the paper. On the other hand, the printing is not completed when the user cannot open the door, so the user must touch the door again after a while to see whether or not the door can be opened.

For this reason, the user cannot accurately recognize a pulling timing of the paper, and is forced to touch the door several times.

SUMMARY

The present invention has been made in view of the above circumferences, and an object of the present invention is to provide a paper ejector unit and a printer which can reduce a distance between an end-of-transport path and a printing mechanism or a cutter, and enable a user to recognize a pulling timing of a printed paper without the user's overload.

To attain the above object of the present invention, one embodiment of the present invention provides a paper ejector unit which transports paper printed by a printing mechanism of a printer along a transport path, including: a paper accumulator provided ahead of an end of the transport path on a downstream side in a transport direction of the paper, the paper accumulator accumulating the paper ejected from the end; a door which opens and closes between a closed condition in which the paper accumulator is separated from an outside and an open condition in which the paper accumulator communicates with the outside; and a door opening and closing controller which maintains the door in the closed condition with no reception of input of an opening operation signal which opens the door, and changes the door from the closed condition to the open condition with reception of the input of the opening operation signal.

On embodiment of the present invention also provides a printer, including: a paper holder which holds paper; a printing mechanism which prints information on the paper; a cutter which cuts the paper; the above-described paper ejector unit, which transports the paper along the transport path; and a controller which controls each operation of the printing mechanism and the cutter.

BRIEF DESCRIPTION OF THE DRAWINGS

The accompanying drawings are included to provide further understanding of the present disclosure, and are incorporated in and constitute a part of this specification. The drawings illustrate embodiments of the present disclosure and, together with the specification, serve to explain the principle of the present disclosure.

DESCRIPTION OF THE PREFERRED EMBODIMENTS

Hereinafter, an embodiment of a paper ejector unit and a printer will be described with reference to the drawings.

Figure 1:
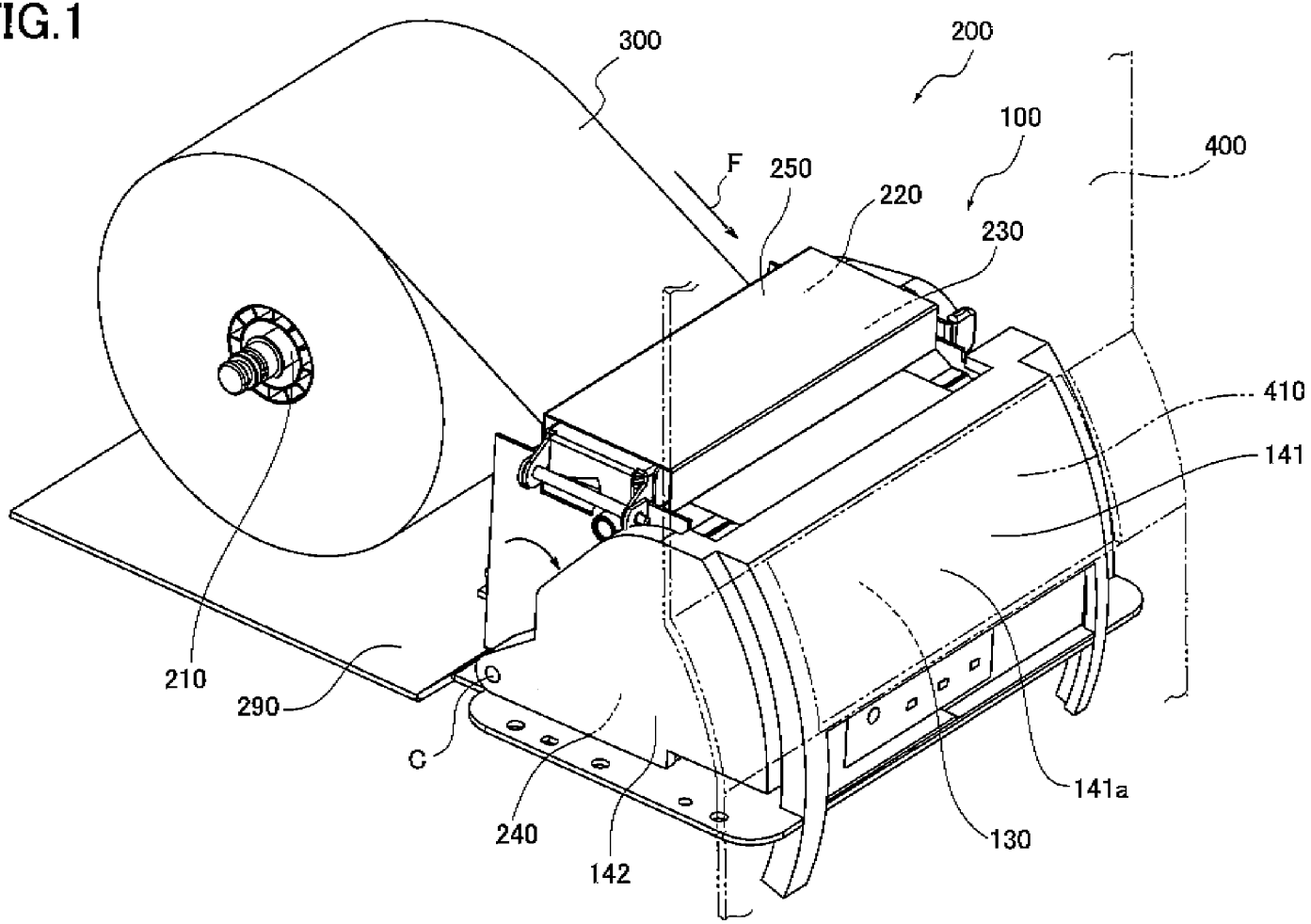
FIG. 1 is a perspective view illustrating one embodiment of a printer including a paper ejector unit as one example of a paper ejector unit according to the present invention.
Figure 2A:
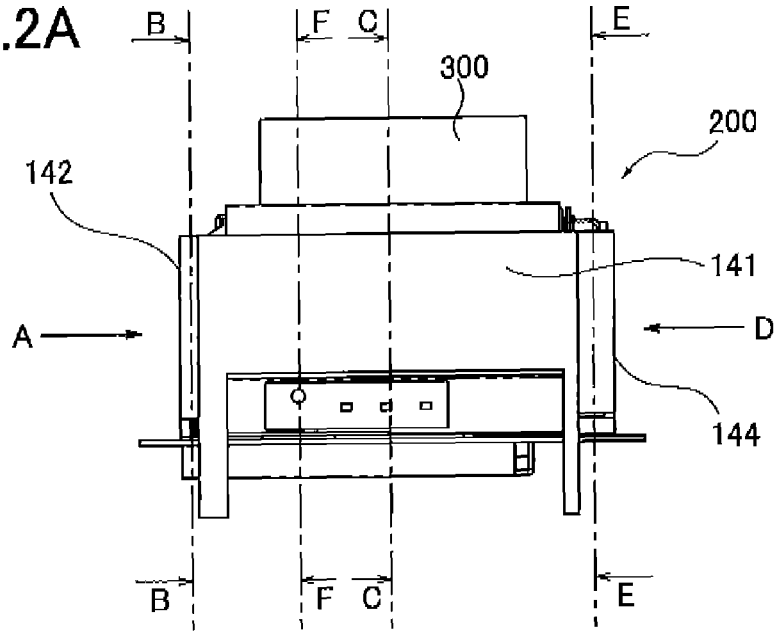
FIG. 2A is a front view of the printer illustrated in FIG. 1.
Figure 2B:
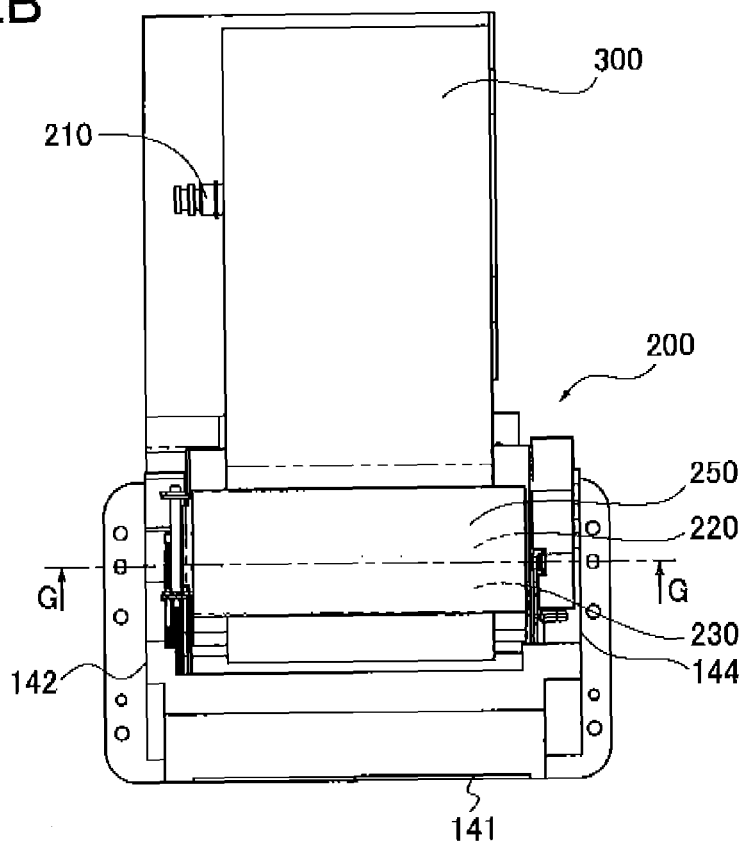
FIG. 2B is a plan view of the printer illustrated in FIG. 1.

A paper ejector unit 100 illustrated in FIG. 1 is one embodiment of a paper ejector unit according to the present invention, and is incorporated into a printer 200 as a part of the printer 200.

(Configuration)

The printer 200 is one embodiment of a printer according to the present invention. The printer 200 includes a paper support shaft 210 (paper holder) which rotatably holds therearound a roll paper 300, a printing mechanism 220 which prints information on the paper 300, a cutter 230 which cuts the paper 300 on which information is printed by the printing mechanism 220, a controller 240 which controls both of printing operation of the printing mechanism 220 and cutting operation of the cutter 230, and the paper ejector unit 100 which stores the information-printed paper 300 during the printing operation and the cutting operation, and makes the stored paper 300 to be pulled (removed) after the cutting operation.

These paper support shaft 210, printing mechanism 220, cutter 230, controller 240 and paper ejector unit 100 are directly supported by a body base 290, or are supported by a sub-frame 291 (FIG. 5) fastened to the body base 290.

In this case, the printing mechanism 220 is disposed in the downstream side of the paper support shaft 210 in the transport direction F of the paper 300, and the cutter 230 is disposed in the downstream side of the printing mechanism 220 in the transport direction F of the paper 300.

The printing mechanism 220 and the cutter 230 are covered by a cover 250.

Figure 3A:
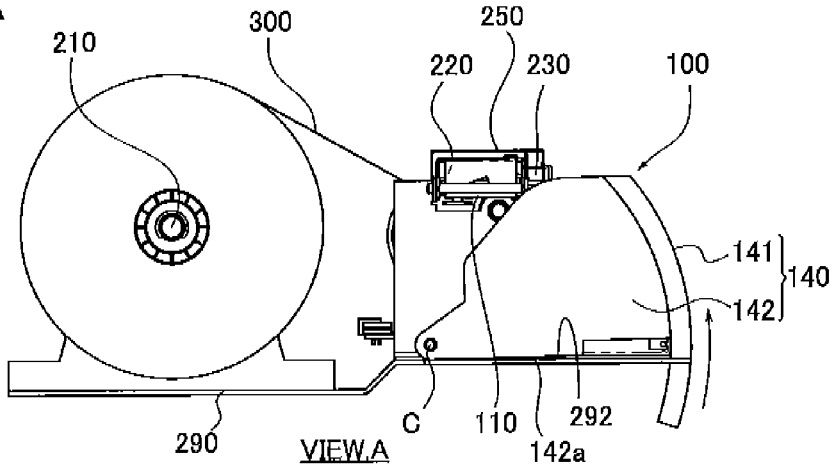
FIG. 3A is a side view based on an arrow view A in FIG. 2A.
Figure 3B:
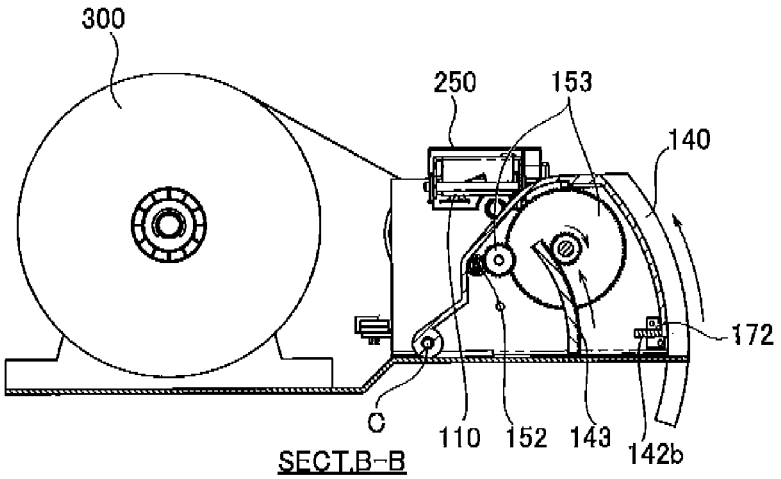
FIG. 3B is a cross-sectional view illustrating a cross-sectional surface along B-B line in FIG. 2A.
Figure 3C:
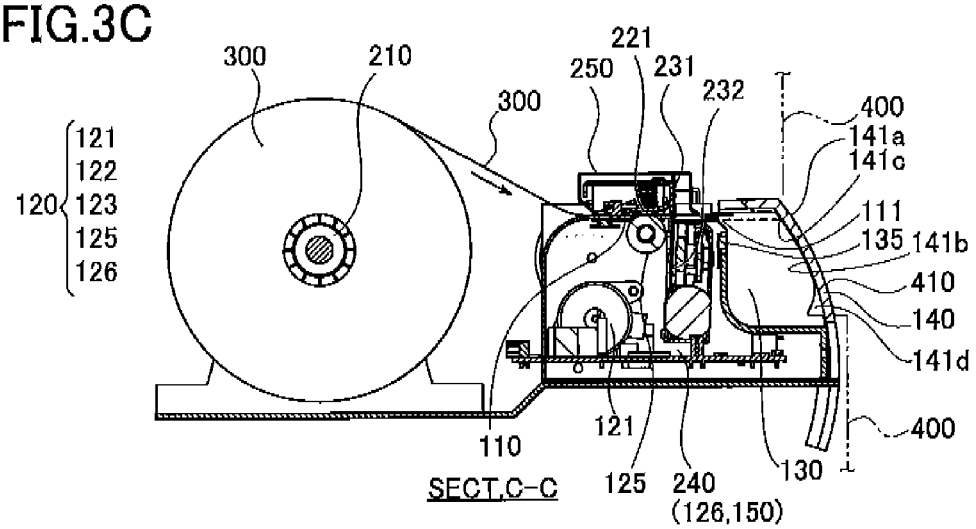
FIG. 3C is a cross-sectional view illustrating a cross-sectional surface along C-C line in FIG. 2A.
Figure 4A:
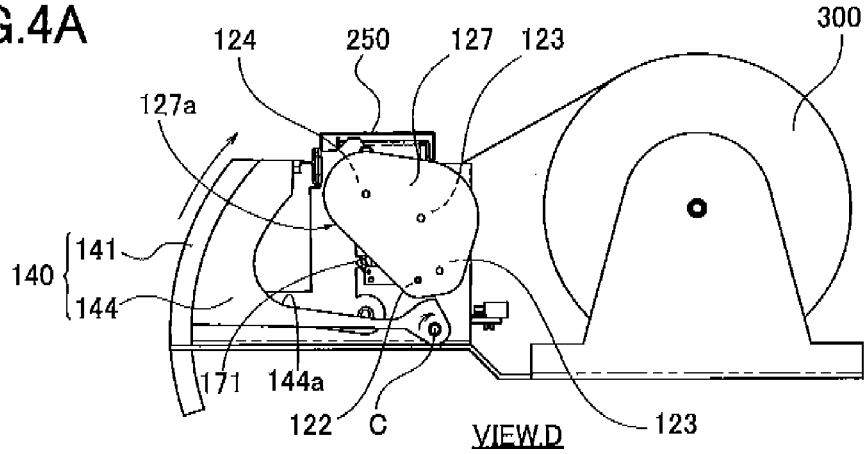
FIG. 4A is a side view based on an arrow view A in FIG. 2A.
Figure 4B:
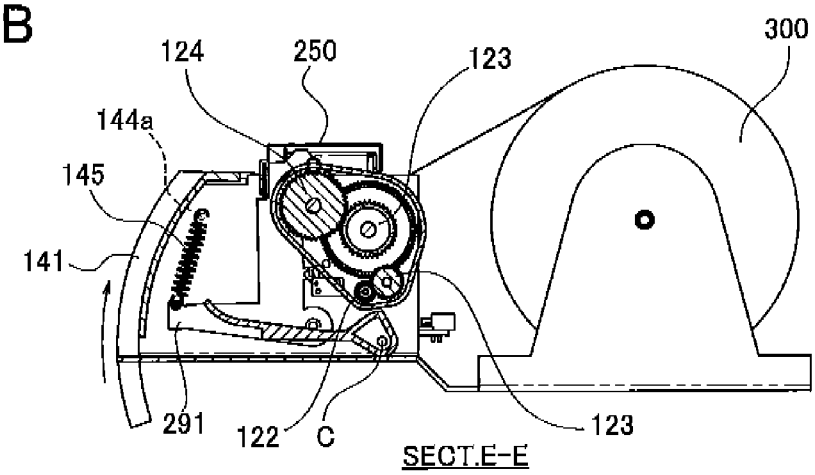
FIG. 4B is a cross-sectional view illustrating a cross-sectional surface along E-E line in FIG. 2A.
Figure 4C:
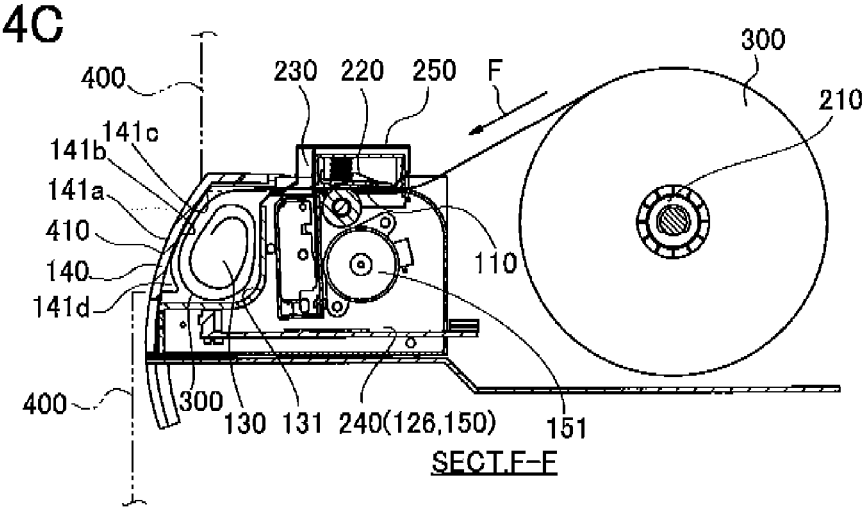
FIG. 4C is a cross-sectional view illustrating a cross-sectional surface along F-F line in FIG. 2A.

As illustrated in FIGS. 3C, 4C, the printing mechanism 220 includes a thermal head 221 above a transport path 110 of the paper 300.

On the other hand, a platen roller 125 in the paper ejector unit 100 is disposed below the transport path 110 of the paper 300 to face the thermal head 221. The platen roller 125 presses the paper 300 to the thermal head 221, and transports the paper 300 downstream along the transport direction F.

Information is printed by the operation of the thermal head 221 on the paper 300 which passes through the transport path 110 between the thermal head 221 and the platen roller 125 while being fed in the downstream direction by the platen roller 125.

The cutter 230 is provided in the downstream side of the printing mechanism 220 in the transport direction F of the paper 300. A fastened blade 231 is disposed above the transport path 110 of the paper 300, and a movable blade 232 is disposed below the transport path 110 of the paper 300. The paper 300 passing through the transport path 110 while being fed in the downstream direction, is sandwiched by the fastened blade 231 and the movable blade 232 by moving up the movable blade 232 to cut the paper 300.

The printing operation control of the printing mechanism 220 by the controller 240 includes, for example, adjustment of printing timing according to contents of printing information relative to the thermal head 221.

The cutting operation control of the cutter 230 by the controller 240 includes adjustment of driving of a motor which moves up and down the movable blade 232 and the driving timing, and the adjustment of the moving-up stroke of the movable blade 232 to switch between full cut which completely cuts the paper 300 and partial cut which partially cuts the paper 300.

The controller 240 outputs an opening operation signal which is an operation signal for opening a door 140 of the paper ejector unit 100 after controlling the cutting operation of the cutter 230.

The paper ejector unit 100 includes a transporter 120 which transports paper along the transport path 110, a paper accumulator 130 which accumulates the paper 300 ejected from the end 111, the paper accumulator 130 being provided ahead of the end 111 of the transport path 110 on the downstream side in the transport direction F of the paper 300 (lower side in vertical direction on downstream side in transport direction F), the door 140 which opens and closes between a closed condition in which the paper accumulator 130 is separated from the outside and an open condition in which the paper accumulator 130 communicates with the outside, and a door opening and closing controller 150 which maintains the door 140 in the closed condition when an opening operation signal for opening the door 140 is not input from the controller 240, and changes the door 140 from the closed condition to the open condition when the input of the opening operation signal is received from the controller 240.

The end 111 of the transport path 110 is located within a few centimeters of the cutter 230. The printed paper 300 cut by the cutter 230 and located more downstream than the cutter 230 falls in the paper accumulator 130 by its own weight.

The transporter 120 includes a platen motor 121 illustrated in FIG. 3C, a platen gear train 123 which is fastened to a rotation shaft of the platen motor 121 and engages with a platen motor gear 122 illustrated in FIG. 4B, the platen roller 125 having a platen gear 124 which engages with the platen gear train 123, and a transport controller 126 which controls the driving of the platen motor 121.

When the driving of the platen motor 121 is controlled by the transport controller 126, the driving force of the platen motor 121 is sequentially transferred to the platen motor gear 122, platen gear train 123, and platen gear 124 so as to drive the platen roller 125, and transport the paper 300 in contact with the platen roller 125 along the transport path 110.

The transport controller 126 is incorporated in the controller 240 of the printer 200. The controller 240 integrally controls the printing operation by the printing mechanism 220 and the cutting operation by the cutter 230 as well as the transport of the transporter 120 by the transport controller 126, so as to control the operation of the entire printer 200.

The platen motor gear 122, platen gear train 123 and platen gear 124 are covered by a cover 127 illustrated in FIG. 4A. The cover 127 protects the platen motor gear 122, platen gear train 123, and platen gear 124 from exterior dust.

The cover 127 is also used as a stopper for the door 140 in the open condition.

Figure 5:
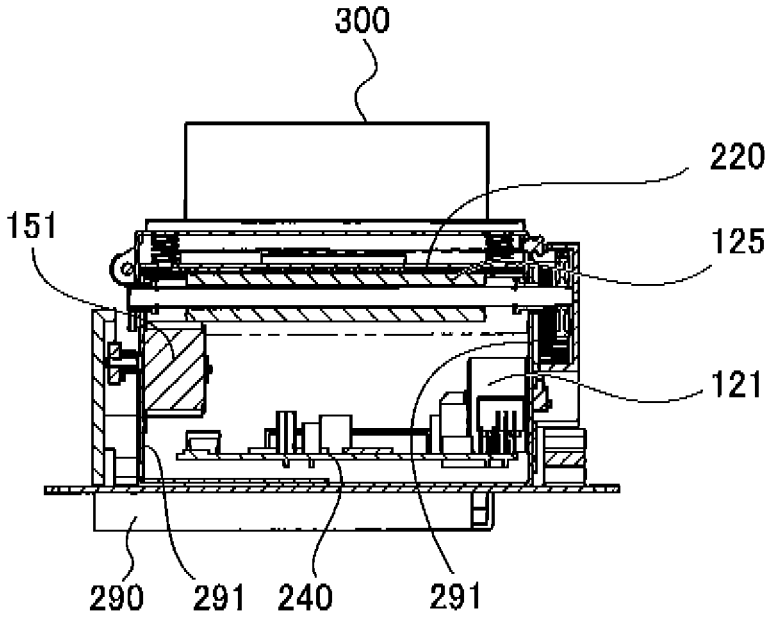
FIG. 5 is a cross-sectional view illustrating a cross-sectional surface along G-G line in FIG. 2B.

The paper accumulator 130 has a space in which the roll paper 300 is accumulated as illustrated in FIG. 4C, and opens on the downstream side in the transport direction F of the paper 300, as illustrated in FIG. 5.

When this open portion is closed by the door 140, as illustrated in FIG. 1, the paper accumulator 130 is separated from the outside. On the other hand, when the open portion is not closed by the door 140, as illustrated in FIG. 5, the paper accumulator 130 communicates with the outside.

Figure 6:
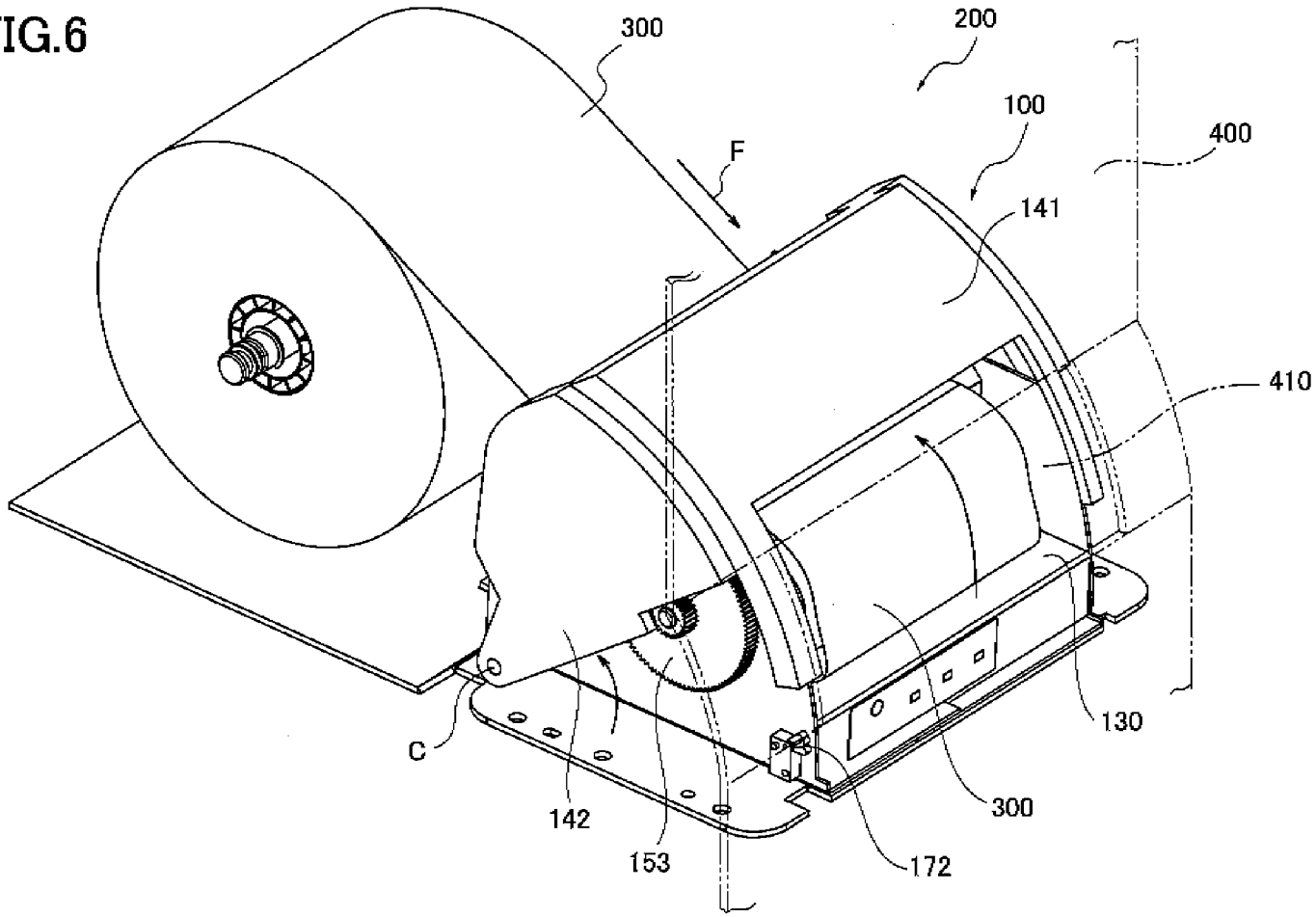
FIG. 6 is a perspective view corresponding to FIG. 1, illustrating a printer with a door being opened.

The printer 200 is disposed in an inside space across an outer wall 400 of a ticket-vending machine, for example. An opening 410 which exposes only the closed door 140 illustrated in FIG. 1 is formed in the outer wall 400. When the door 140 is closed (FIG. 1), a user cannot access the paper accumulator 130 from a space outside the outside wall 400. When the door 140 is open (FIG. 6), a user can access the paper accumulator 130 from the outside space.

A door opening and closing controller 150 is also incorporated in the controller 240 of the printer 200, similar to the transport controller 126. The controller 240 integrally controls the cutting operation of the cutter 230 and the opening and closing operation of the door 140 by the door opening and closing controller 150.

In addition, the door 140 is biased to be closed by the elastic force of a spring 145 connected to the sub frame 291 and a side plate 144 of the door 140 as illustrated in FIG. 4B The controller 240 outputs a cut signal (operation signal) which indicates the moving up of the moving blade 232 relative to the cutter 230, and outputs an opening operation signal of the door 140 to the door opening and closing controller 150 in response to the cutting operation of the cutter after the controller 240 outputs the cut signal.

Upon the reception of the input of the opening operation signal of the door 140, the door opening and closing controller 150 changes the door 140 to the open condition based on the opening operation signal, and maintains the door in the closed condition the rest of the time.

Namely, upon the output of the cut signal to the cutter 230, the cutter 230 cuts the paper 300 in response to the reception of the cut signal, and the cut paper 300 is accumulated in the paper accumulator 130 to be pulled.

The door opening and closing controller 150, which has received the input of the opening operation signal of the door 140 output after the cut signal, changes the door 140 biased in the closed condition by the spring 145 from the closed condition to the open condition after a predetermined delay time has passed since the reception of the input of the opening operation signal.

In this case, the delay time can be predetermined based on an experiment or the like. For example, the time required to complete the cutting of the paper 300 after the cut signal is output can be adopted as the delay time.

As illustrated in FIGS. 3A to 4C, the door 140 includes a front shutter plate 141 facing the opening 410 of the outer wall 400, and side plates 142, 144 extending on both sides of the front shutter plate 141. The door 140 is rotatable about the axis C parallel in the width direction of the paper 300, which connects the ends of both side plates 142, 144.

The front shutter plate 141 is formed in a cylindrical form having a sectional arc-like contour shape having the axis C as a center, and the door 140 rotates to pass through the outside of the paper accumulator 130 in accordance with an orbit along the sectional arc-like contour shape of the front shutter plate 141.

As illustrated in FIG. 3C and FIG. 4C, an inner surface 141*b* of the front shutter plate 141 has an inclination along the oblique direction between the downstream direction in the transport direction F of the paper 300 and the lower side in the vertical direction.

A guide projection 141*d* which guides the paper 300 falling along the inner surface 141*b* of the front shutter plate 141 to U-turn toward the end 111 is formed in the inner surface 141*b* of the front shutter plate 141. The guide projection 141*d* is located below a portion 141*c* intersecting with the extending line (two-dot chain line in FIGS. 3C, 4C) of the end 111 of the transport path 110.

An arc-like rack 143 having a constant distance from the shaft C is formed in the inner surface of one side plate 142 of both side plates 142, 144, as illustrated in FIG. 3B.

A driving gear 152 (FIG. 3B) provided in the shaft of the door opening and closing DC motor 151 (FIG. 4C) of the door opening and closing controller 150 of the paper ejector unit 100 engages with the driving gear train 153, and the driving gear train 153 engages with the rack 143.

As a result, the door opening and closing controller 150 controls the driving of the door opening and closing DC motor 151, so that the driving force of the door opening and closing DC motor 151 is transferred to the driving gear train. 153 and the rack 143 to open and close the door 140.

Figure 7:
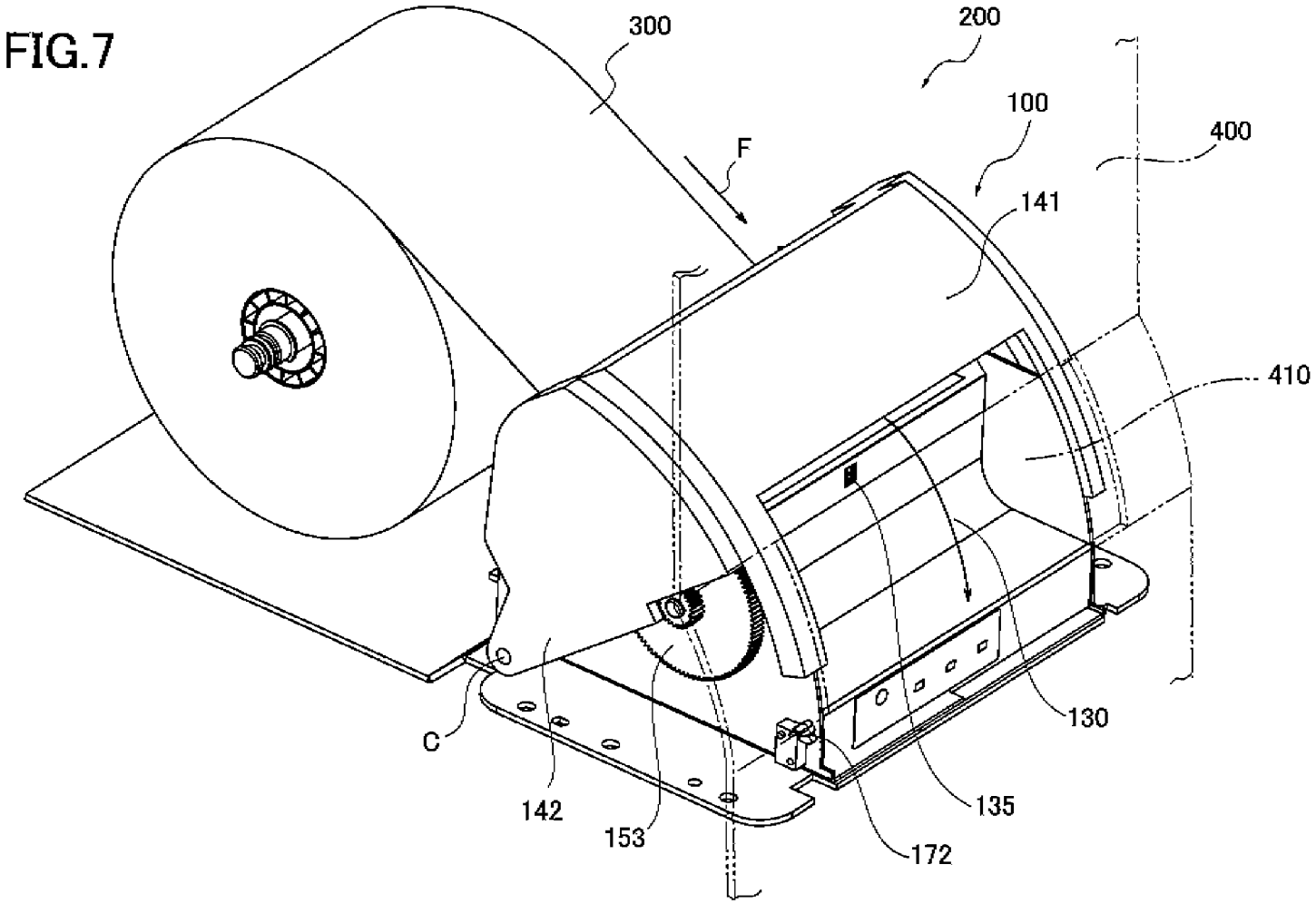
FIG. 7 is a perspective view corresponding to FIG. 1, illustrating a printer with a door being opened and a printed paper being pulled.

The paper accumulator 130 includes a paper detector 135 which optically detects the presence or absence of the paper 300 in, the paper accumulator 130, as illustrated in FIG. 7. When the door opening and closing controller 150 receives the detection result of the absence of the paper 300 by the paper detector 135, the driving of the door opening and closing DC motor 151 is controlled to change the door 140 from the open condition to the closed condition.

Just after the door opening and closing controller 150 receives the detection result of the absence of the paper 300 by the paper detector 135, the door opening and closing controller 150 can control the driving of the door opening and closing DC motor 151. However, the door opening and closing controller 150 can control the driving of the door opening and closing DC motor 151 after a predetermined delay time has passed since the reception of the detection result of the absence of the paper 300.

The door opening and closing controller 150 controls the door 140 to be maintained in the closed condition when there is no input of the opening operation signal of the door 140 to the door opening and closing controller 150 from the controller 240 of the printer 200.

In this case, a cut signal is output to the cutter 230 from the controller 240 before outputting the opening operation signal of the door 140. However, when there is no output of the cut signal, it is a condition in which the paper 300 is not cut, namely, a condition in which the paper 300 is being printed by the printing mechanism 220, or a condition in which the door is closed after the paper 300 is pulled from the paper accumulator 130.

The door 140 is closed while the paper 300 is printed by the printing mechanism 220. With this configuration, a user cannot improperly touch the paper 300.

On the other hand, after the paper 300 is pulled from the paper accumulator 130, the door 140 is then closed, if there is no further paper 300 to be pulled from the paper accumulator 130. Thus, the door 140 is in a closed condition and the paper accumulator 130 can be prevented from accumulating rain, wind, or dust.

The door opening and closing controller 150 stops the door opening and closing DC motor 151 without driving the motor, so that the door 140 is maintained in the closed condition. When the door opening and closing DC motor 151 stops, the door 140 is biased in the closed condition by the spring 145. As a result, the door opening and closing controller 150 controls the door 140 to be maintained in the closed condition.

(Operation)

Figure 8:
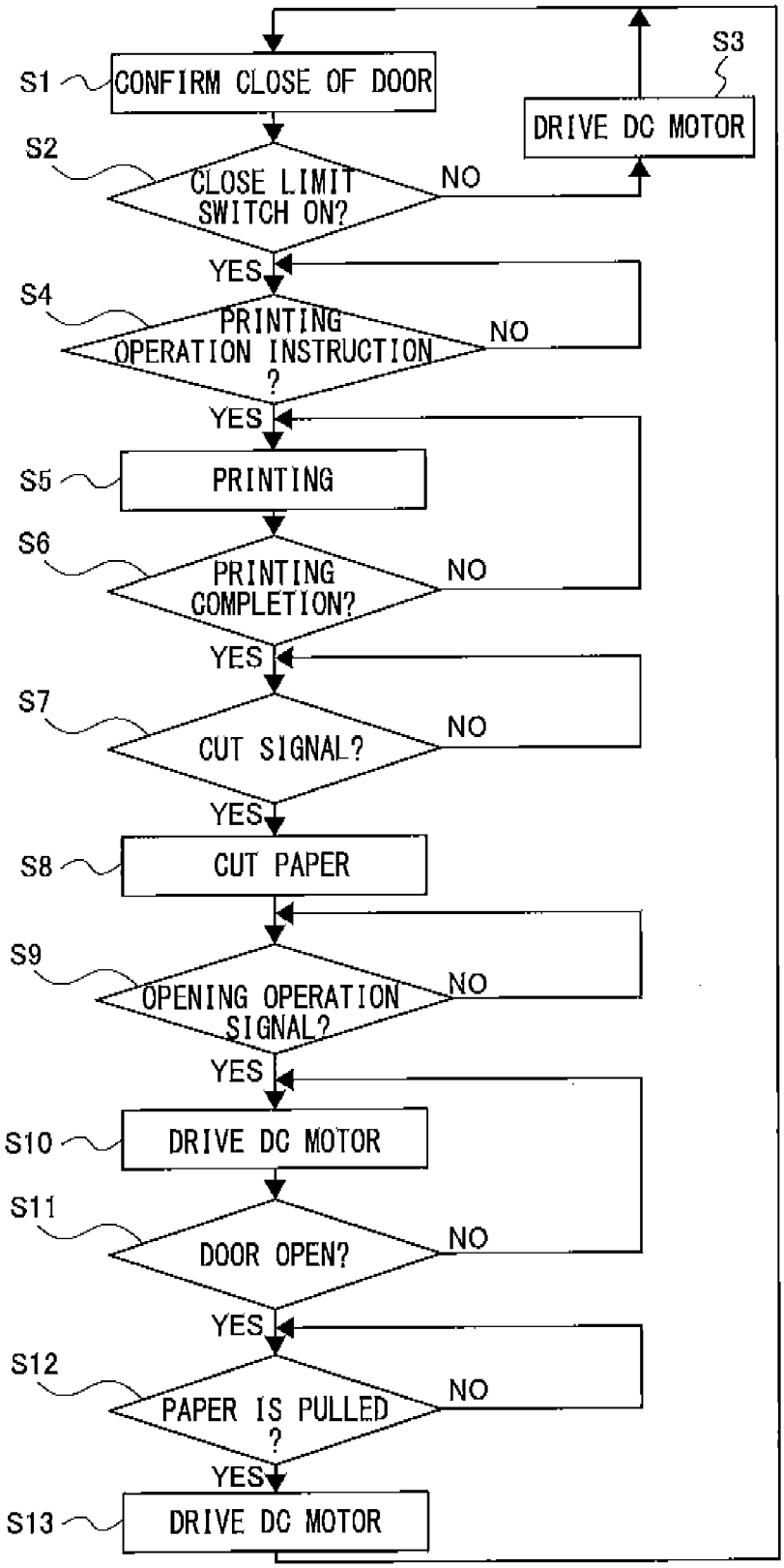
FIG. 8 is a flowchart describing an operation of a printer.

Next, the operation of the printer 200 and the paper ejector unit 100 of the present embodiment will be described with reference to the flowchart in FIG. 8.

At first, the closed condition of the door 140 is confirmed (S1).

During an initial condition or while printing is not being performed, the controller 240 of the printer 200 as the door opening and closing controller 150 does not drive the door opening and closing DC motor 151, so that the door 140 is closed by the elastic force of the spring 145, as illustrated in FIG. 1.

While the door 140 is closed, the opening 410 formed in the outer wall 400 is closed by the front shutter plate 141 of the door 140. Thus, a user cannot access the paper accumulator 130 of the paper ejector unit 100 from the space outside the outer wall 400.

The outer surface 141*a* of the front shutter plate 141 facing the outside space from the opening 410 is a smooth cylindrical surface. This configuration makes it difficult for a user to open the door 140 against the elastic force of the spring 145 only by a frictional force between fingers and the outer surface 141*a* of the front shutter plate 141 because there is no guide for fingers if a user tries to forcibly open the door 140.

Therefore, a user cannot basically open the closed door 140, and cannot access the paper accumulator 130.

In addition, it can be detected that the door 140 is in the closed condition (Step 2) with a close limit switch 172 attached to the sub frame 291.

When the door 140 is not in the closed condition, namely, the close limit switch 172 is not switched on, the door opening and closing controller 150 controls the driving of the door opening and closing DC motor 151 to close the door 140 (Step 3).

Next, the controller 240 instructs the printing operation to the printing mechanism 220, so that information is printed on the paper 300 by the thermal print head 221 (Steps 4-6).

The platen motor 121 is driven by the control of the controller 240 as the transport controller 126 to the platen motor 121 in parallel with the printing, the driving force of the platen motor 121 is transferred to the platen gear 124 through the platen gear train 123 engaging with the platen motor gear 122, the platen roller 125 rotates, and the printed paper 300 is transported downstream in the transport direction F along the transport path 110.

Information can be thereby printed on the paper 300 while transporting the paper 300.

A distance from the printing mechanism 220 to the end 111 of the transport path 110 is short and is within a several centimeter distance. For this reason, the printed tip of the paper 300 transported downstream reaches the paper accumulator 130 after passing through the end 111 of the transport path 110 during the printing of the paper 300.

When the length of the printed paper 300 is increased, the tip of the paper 300 on the downstream side in the transport direction F falls by its own weight, and is accumulated in the paper accumulator 130.

In this case, if the paper 300 is thick, the deflection of the paper 300 is small because the elasticity of the paper 300 is strong. The falling amount of the tip of the paper 300 on the downstream side is therefore decreased, and the tip sometimes has contact with the inner surface 141*b* of the front shutter plate 141 of the closed door 140.

The inner surface 141*b* of the front shutter plate 141 has a sectional arc-like shape, and includes an inclination along an oblique direction (anteroinferior oblique direction) between the lower side in the vertical direction and the downstream direction in the transport direction F of the paper 300. The tip of the paper 300 which has contact with the inner surface 141*b* is thereby guided in the anteroinferior oblique direction along the inner surface 141*b*.

The tip of the paper 300 guided in the anteroinferior oblique direction along the inner surface 141*b* runs CM the guide projection 141*d* formed in the lower side of the inner surface 141*b*, and travels to U-turn toward the end 111.

The end of the paper 300 U-tuned inside the paper accumulator 130 travels along the inner surface 131 as a partition of the paper accumulator 130 because the inner surface 131 is formed in an approximate cylindrical inner surface shape. The printed paper 300 is therefore rolled up inside the paper accumulator 130 to be accumulated, as illustrated in FIG. 4C.

As described above, the paper 300 can be compactly housed in the paper accumulator 130 by rolling up the paper 300 as described above, even if the paper 300 is relatively long having such as about 30 centimeters in length, for example.

Moreover, it is not necessary to provide between the end 111 of the transport path 110 and the printing mechanism 220 or the cutter 230 an ejection standby space in which the paper 300 is deflected. The distance between the end 111 of the transport path 110 and the printing mechanism 220 or the cutter 230 can be reduced.

Since the distance between the end 111 of the transport path 110 and the printing mechanism 220 or the cutter 230 can be reduced to have a short distance of about several centimeters, the paper 300 fails in the paper accumulator 130 to be pulled without having a transport device which transports the paper 300 downstream in the transport direction F after cutting the paper 300 by the cutter 230 even when the cut paper 300 is short such as about 2 centimeters in length.

After the printing instruction to the printing mechanism 220 corresponding to information to be printed on the paper 300 is completed, the thermal head 221 completes the printing to the paper 300 (Step 6).

Next, the controller 240 outputs the cut signal indicating the cutting operation to the cutter 230 (Step 7), so that the movable blade 232 of the cutter 230 moves up. The fixed blade 231 and the movable blade 232 thereby sandwiches the paper 300 to cut the paper 300 (Step 8).

The platen roller 125 rotates to feed the paper 300 downstream in the transport direction F until just before the paper 300 is cut with the fixed blade 231 and the movable blade 232. The driving of the platen motor 121 is stopped by the transport controller 126 to stop the paper 300 when cutting the paper 300 with the fixed blade 231 and the movable blade 232.

The printed paper 300 cut more downstream than the cutter 230 by the cutter 230 is separated from the transport path 110 to fall in the paper accumulator 130 by the weight of the portion projected from the end 111 of the transport path 110. The paper 300 can be thereby pulled by a user.

After the controller 240 outputs the cut signal indicating the cutting relative to the cutter 230, the controller 240 outputs the opening operation signal for opening the door 140 to the door opening and closing controller 150 incorporated into the controller 240.

The door opening and closing controller 150 drives the door opening and closing DC motor 151 (Step 10) after a predetermined time has passed since the reception of the opening operation signal (Step 9), and transfers the driving force of the door opening and closing DC motor 151 through the driving gear train 153 engaging with the driving gear 152, and drives the rack 143 against the elastic force of the spring 145.

The rack 143 extends in an arc-like shape having an equal distance from the shaft C, and is formed in one side plate 142 of the door 140. Upon the driving of the rack 143, the door 140 rotates about the shaft C from the closed condition illustrated in FIG. 1 to be in the open condition illustrated in FIG. 6 (Step 11).

In this case, when the door 140 is changed from the closed condition to the open condition, the outer circumferential rim of the cover 127 illustrated in FIG. 4A touches the concave contour rim 144*a* of the side plate 144 of the door 140. With this configuration, the outer circumferential rim of the cover 127 becomes a stopper which stops the rotation of the door 140 to the open condition so as to prevent the door 140 from further opening.

As illustrated in FIG. 4A, an open limit switch 171 to which the concave contour rim 144*a* of the side plate 144 touches is attached to the sub frame 291. The open limit switch 171 touches the concave contour rim 144*a* of the side plate 144 just before the rotation of the door 140 to the open condition is stopped by the stopper. Upon, the touching of the concave contour rim 144*a* of the side plate 144 to the open limit switch 171, the open limit switch 171 outputs the opening detection signal indicating that the door 140 has reached the open condition to the door opening and closing controller 150.

The door opening and closing controller 150 controls the door opening and closing DC motor 151 to stop the driving of the door opening and closing DC motor 151 in response to the reception of the opening detection signal, so as to prevent the continuous driving of the door opening and closing DC motor 151.

In the open condition of the door 140, the space outside the outer wall 400 communicates with the paper accumulator 130 of the paper ejector unit 100 in the inside space. A user can access the paper accumulator 130 of the paper ejector unit 100 from the space outside the outer wall 400, and pull the printed paper 300 accumulated in the paper accumulator 130 through the opening 410.

After the paper 300 is pulled from the paper accumulator 130 (Step 12), the paper detector 135 in the paper accumulator 130 outputs the detection result of the absence of the paper 300 to the door opening and closing controller 150, and the door opening and closing controller 150 which has received the detection result of the absence of the paper 300 controls the driving of the door opening and closing DC motor 151 to change the door 140 from the open condition to the closed condition (Step 13).

When the door opening and closing DC motor 151 is driven to change the door 140 from the closed condition to the open condition, the driving of the door opening and closing DC motor 151 is controlled in the opposite driving direction.

Timing in which the door opening and closing controller 150 controls the driving of the door opening and closing DC motor 151 to change the door 140 from the open condition to the closed condition can be a timing just after the reception of the detection result of the absence of the paper 300 from the paper detector 135, or can be a timing after a predetermined time has passed since the reception of the detection result similar to the change in the door 140 to the open condition.

When the door opening and closing controller 150 controls the driving of the door opening and closing DC motor 151 so as to close the door 140 from the open condition to the closed condition, the top surface 292 of the body base 290 illustrated in FIG. 3A touches the bottom edge 142*a* of the side plate 142 of the door 140. With this configuration, the top surface 292 of the body base 290 becomes a stopper of the rotation of the door 140 to the closed condition so as to prevent the door 140 from further being closed.

The close limit switch 172 to which the rib 142*b* (FIG. 3B) formed inside the border between the side plate 142 and the front shutter plate 141 touches is formed in the sub frame 291. The close limit switch 172 touches the rib 142*b* just before the rotation of the door 140 to the closed condition is stopped by the stopper. Upon the touching of the rib 142*b* to the close limit switch 172, the close limit switch 172 outputs the close detection signal indicating that the door 140 has reached the closed condition to the door opening and closing controller 150.

The door opening and closing controller 150 controls the door opening and closing DC motor 151 to stop the driving of the door opening and closing DC motor 151 in response to the close detection signal, so as to prevent the continuous driving of the door opening and closing DC motor 151.

(Effect)

According to the paper ejector unit 100 of the present embodiment as described above, the paper 300 printed by the printing mechanism 220 of the printer 200 is ejected from the end 111 of the transport path 110, and is accumulated in the paper accumulator 130 provided ahead of the end 111 (downstream direction in transport direction F).

The door 140, which opens and closes such that the paper accumulator 130 is separated from the outside in the closed condition and the paper accumulator 130 communicates with the outside in the open condition, is provided in the paper accumulator 130. The door 140 is maintained in the closed condition by the door opening and closing controller 150 when the door opening and closing controller 150 does not receive the input of the opening operation signal of the door 140.

Before the cut signal of the cutter 230 is output, the paper 300 is not cut. In this case, the printing to the paper 300 may be continued. Even if the tip of the paper 300 is accumulated in the paper accumulator 130, the printing may be displaced if a user pulls the tip of the paper 300 accumulated in the paper accumulator 130. If a user closes the end 111 of the transport path 110, the paper 300 may become jammed on the transport path 110.

However, in the paper ejector unit 100 of the present embodiment, before the cut signal for cutting the paper 300 by the cutter 230 of the printer 200 is output, the opening operation signal of the door 140 is not input to the door opening and closing controller 150, so that the door 140 is maintained in the closed condition by the door opening and closing controller 150.

Therefore, the paper accumulator 130 is separated from the outside (space outside outer wall 400) by the door 140. With this configuration, a user cannot access the paper accumulator 130 from the outside.

Accordingly, paper 300 while printing can be reliably prevented from being pulled by a user.

The end 111 of the transport path 110 faces the paper accumulator 130. The end 111 of the transport path 110 is thereby covered by the door 140 when the door 140 is closed, so that a user cannot access the end 111.

With this configuration, the end 111 is not closed by a user; thus, the paper 300 can be reliably prevented from being stuck on the transport path 110.

On the other hand, the opening operation signal of the door 140 is output after completing the printing to the paper 300 by the printer 200, and cutting the paper 300 by the cutter 230 at an appropriate length. For this reason, when the opening operation signal of the door 140 is output, the paper 300 is cut by the cutter 230 and the cut paper is accumulated in the paper accumulator 130 to be pulled by a user.

In this case, the door 140 is changed from the closed condition to the open condition by the door opening and closing controller 150 when the door opening and closing controller 150 receives the input of the opening operation signal of the door 140.

A user can thereby access the paper accumulator 130 after confirming the open condition of the door 140, and can confirm that the paper 300 can be pulled at an appropriate timing.

Accordingly, a user is not forced to use a confirmation operation requiring the door 140 to be touched several times, for example.

A user can therefore pull the paper 300 accumulated in the paper accumulator 130 communicating with the outside with the door 140 being opened.

It becomes unnecessary to stand by the paper 300 before cutting ahead of the end 111 of the transport path 110 (upstream portion of transport direction F) with the configuration in which the paper accumulator 130 is provided in the end 111 of the transport path 110. Therefore, it becomes unnecessary to ensure such a standby place between the end 111 of the transport path 110 and the printing mechanism 220 of the printer 200.

Thus, the cutter 230 and the printing mechanism 220 of the printer 200 can be disposed close to the end 111 of the transport path 110, so that the entire size of the printer can be decreased.

In the paper ejector unit 100 of the present embodiment, since a passing portion of the door 140 when moving between the open condition and closed condition is a portion outside the paper accumulator 130, the door 140 does not pass through the paper accumulator 130. Therefore, the paper 300 accumulated in the paper accumulator 130 can be prevented from damage (bending or breaking) which occurs when the door 140 passes through the paper accumulator 130.

If the door 140 opens to enter the paper accumulator 130 as a door of a coin return slot of a vending machine, it is necessary to remove the paper 300 from a space except the entered door 140. Therefore, it is difficult to remove the paper 300 from that space without being damaged when the paper 300 is largely expanded in the paper accumulator 130.

However, in the paper ejector unit 100 of the present embodiment, the door 140 opens to pass through the portion outside the paper accumulator 130; thus, such effort is unnecessary.

The movement of the door 140 is rotation about the shaft C parallel to the width direction of the paper 300 as the central axis. The movement of door 140 can, be more stable than the up-and-down movement along the vertical direction.

Moreover, the paper accumulator 130 expands in the lower side in the vertical direction and the downstream side in the transport direction F of the paper 300 relative to the end 111 of the transport path 110, so that the paper 300 ejected from its tip, which is cut ahead of the end 111, falls in the paper accumulator 130 by the its own weight to be accumulated.

On the other hand, when the cut paper 300 is long, the tip of the paper 300 on the downstream side in the transport direction F may touch the inner surface 141*b* of the door 140, but a part of the inner surface 141*b* of the door 140 to which the tip of the paper 300 touches has an inclination along an oblique direction between the downstream direction in the transport direction F of the paper 300 and the lower side in the vertical direction, namely, an inclination toward the anteroinferior oblique direction in the transport direction. The tip of the paper 300 is thereby guided in the anteroinferior oblique direction along the inclination, and is accumulated in the paper accumulator 130 with the paper 300 being rolled up along the inner surface 141*b* of the door 140 or the inner surface 131 of the paper accumulator 130.

The paper 300 can be therefore accumulated in the paper accumulator 130 regardless of its length.

In the paper ejector unit 100 of the present embodiment, the paper 300 falls along the inner surface 141*b* of the door 140, and the paper 300 is guided to U-turn toward the end 111 of the transport path 110 by the guide projection 141*b* formed in the inner surface 141*b* of the door 140. With this configuration, the paper 300 can be easily rolled up inside the paper accumulator 130.

In the paper ejector unit 100 of the present embodiment, the orbit of the door 140 passing through the front shutter plate 141 has a sectional arc-like contour shape of the front shutter plate 141. Thus, the dead space due to the opening and closing of the front shutter plate 141 can be minimized, and the space can be reduced.

In the paper ejector unit 100 of the present embodiment, when the paper 300 accumulated in the paper accumulator 130 can be pulled (paper 300 is cut by cutter 230 to be accumulated in paper accumulator 130), the door 140 is changed from the closed condition to the open condition by the door opening and closing controller 150. After a user pulls the paper 300 of the paper accumulator 130 with the door 140 being opened, if the door 140 is left with, the door 140 being opened, the paper accumulator 130 may be exposed to rain and wind depending on an environment, so that sand, dust, water or the like may enter the transport path 110.

However, in the paper ejector unit 100 of the present embodiment, the paper detector 135 detects the absence of the paper 300 in the paper accumulator 130 after the paper 300 is pulled, and the door opening and closing controller 150 receives the detection result of the paper detector 135 to change the door 140 from the open condition to the closed condition, and thus, the transport path 110 can be prevented from being exposed to rain and wind.

In addition, in the paper ejector unit according to the present invention, the door can be a door which rotates in an arc-like shape as the door 140 of the embodiment of the present invention, can be a door which linearly slides, or can be a door whose size is changed to be folded, for example.

As a method of driving a door for changing a door between the open condition and the closed condition, a method with an electric motor such as a DC motor or a PM motor, a method with a solenoid, or a method with air pressure can be used.

Various sensors (open limit switch 171, close limit switch 172, paper detector 135) for use in the paper ejector unit 100 of the present embodiment can be other detectors.

Namely, an optical sensor (for example, photo interrupter or photo reflector), electric sensor, magnetic sensor, or the like can be adopted instead of the mechanical switch such as the open limit switch 171 or the close limit switch 172.

A mechanical switch, electric sensor, magnetic sensor, or the like can be adopted instead of the optical sensor such as the paper detector 135.

The paper detector 135 can detect that the paper 300 has not reached the paper accumulator 130 due to the jamming of the paper 300 in the transport path 110. Therefore, it can be used as a sensor which detects the jamming of the paper 300.

In the paper ejector unit 100 of the present embodiment, the door opening and closing controller 150 changes the door 140 to the open condition after a predetermined delay time has passed since the reception of the opening operation signal, and the door opening and closing controller 150 changes the door 140 to the closed condition after a predetermined delay time has passed since the reception of the detection result of the absence of the paper 300 in the paper accumulator 130. However, in the paper ejector unit of the present invention, the door opening and closing controller 150 changes the door 140 to the open condition just after the reception of the opening operation signal, and the door opening and closing controller 150 changes the door 140 to the closed condition just after the reception of the detection result of the absence of the paper 300 without providing the delay time.

Since the printer 200 of the present embodiment includes the paper ejector unit 100 of the present embodiment, the printer 200 of the present embodiment performs the operations by the paper ejector unit 100, and also obtains the effects by the paper ejector unit 100.

In the printer 200 of the present embodiment, the controller 240 of the printer 200 includes the door opening and closing controller 150 of the paper ejector unit 100, so that it is unnecessary for the paper ejector unit 100 to have an individual door opening and closing controller. Since the controller 240 controls the printing mechanism 220 or the cutter 230, the control of the printing mechanism 220, the control of the cutter 230, and the opening and closing control of the door 140 can be accurately performed.

Moreover, the printer 200 of the present embodiment is described as a thermal printing mechanism in which the thermal head 221 is adopted as the printing mechanism 220. However, the printer of the present invention is not limited thereto. Various types of printing mechanisms such as an ink-jet type printing mechanism or a photosensitive drum type printing mechanism using laser light can be used.

Furthermore, the cutter of the present invention is not limited to the cutter 230 in the above embodiment. Various types of cutters can be adopted. Although the embodiment of the present invention has been described above, the present invention is not limited thereto. It should be appreciated that variations may be made in the embodiment described by persons skilled in the art without departing from the scope of the present invention.

In the paper ejector unit and the printer according to the embodiment of the present invention, the paper accumulator provided with the door is disposed ahead of the end of the transport path. With this configuration, the distance between the end-of-transport path and the printing mechanism or the cutter is reduced, and the door is closed while printing paper, so as to prevent the paper while printing from being touched by a user. On the other hand, the door opens in response to the reception of the opening operation signal of the door. Accordingly, a user can recognize a pulling timing of the printed paper without user's overload.

According to the paper ejector unit and the printer of the embodiment of the present invention, the printer can be downsized by reducing the distance between the end-of-transport path and the printing mechanism or the cutter, and a user can recognize the printing timing of the printed paper without being overloaded.

What is claimed is:

1. A printer, comprising:

a paper holder which holds paper;

a printing mechanism which prints information on the paper;

a cutter which cuts the paper;

a paper ejector unit which transports the paper along a transport path; and a printer controller which controls each operation of the printing mechanism and the cutter, and which is operable to send an opening operation signal after a cutting operation by the cutter;

wherein the paper ejector unit comprises:

a paper accumulator provided downstream of an end of the transport path, the paper accumulator accumulating the paper ejected from the end of the transport path;

a door which opens and closes between a closed condition in which the paper accumulator is separated from an outside and an open condition in which the paper accumulator communicates with the outside; and a door opening and closing controller which maintains the door in the closed condition with no reception of the opening operation signal, is operable to receive the opening operation signal from the printer controller after a cutting operation by the cutter, and changes the door from the closed condition to the open condition with reception of the opening operation signal, wherein the door is provided to be rotatable about an axis parallel to a width direction of the paper as a central axis, and is rotatably switched to the closed condition or the open condition, wherein the paper accumulator comprises a space located at the end of the transport path and positioned at a lower height than the end of the transport path, wherein the door is formed to have a sectional arc-like contour shape, and an inner surface of the door is concave and curves downward and away from the end of the transport path, wherein the door is provided to rotate with an orbit along the sectional arc-like contour shape, wherein a center of curvature of the sectional arc-like contour shape of the door coincides with a rotation center of the door, and wherein the paper accumulator, the end of the transport path and the cutter are positioned with respect to each other, and the door opening and closing controller is operable to change the door from the closed position to the open position, so that after the paper is cut by the cutter, the paper is accumulated in the accumulator and then the door is changed from the closed position to the open position.

2. The printer according to claim 1, wherein a guide projection, which guides the paper falling down along the inner surface of the door toward the end, is formed on the inner surface of the door below a line extending from the end of the transport path.

3. The printer according to claim 1, further comprising a paper detector which detects the presence or absence of the paper in the paper accumulator, wherein the door opening and closing controller changes the door from the open condition to the closed condition in response to reception of a detection result of the absence of the paper by the paper detector.

4. The printer according to claim 1, wherein the door opening and closing controller of the paper ejector unit is incorporated into the printer controller.

5. The printer according to claim 1, wherein the paper accumulator is fixed in position at the end of the transport path, the paper accumulator having an inner surface fixed in position to define the space located at the end of the transport path and positioned at a lower height than the end of the transport path.

* * * * *